US008336503B2

(12) United States Patent
Spinelli

(10) Patent No.: US 8,336,503 B2
(45) Date of Patent: Dec. 25, 2012

(54) HARNESS

(75) Inventor: Christopher R. Spinelli, Springfield, MO (US)

(73) Assignee: Genius Happens, LLC, Springfield, MO (US)

( * ) Notice: Subject to any disclaimer, the term of this patent is extended or adjusted under 35 U.S.C. 154(b) by 157 days.

(21) Appl. No.: 13/033,837

(22) Filed: Feb. 24, 2011

(65) Prior Publication Data

US 2011/0203531 A1 Aug. 25, 2011

Related U.S. Application Data

(60) Provisional application No. 61/307,565, filed on Feb. 24, 2010.

(51) Int. Cl.
*A62B 35/00* (2006.01)

(52) U.S. Cl. ..... 119/770; 182/3; 434/255

(58) Field of Classification Search ..... 119/712, 119/769, 770, 772, 792, 856, 857, 858, 863, 119/865, 907; 182/3, 4; 224/184; 244/151 R; 434/254, 255

See application file for complete search history.

(56) References Cited

U.S. PATENT DOCUMENTS 1,193,374 A 8/1916 Gilliam
1,288,170 A * 12/1918 Pick ..... 297/484
1,697,363 A * 1/1929 Losey ..... 297/484
1,749,999 A 3/1930 Crocker
3,301,594 A * 1/1967 Pukish, Jr. ..... 297/467
4,197,816 A 4/1980 Lusch
4,273,215 A * 6/1981 Leggett ..... 182/3
4,303,041 A 12/1981 Thompson et al.
4,424,040 A 1/1984 Buchheister et al.
4,537,154 A 8/1985 Kay
4,712,513 A * 12/1987 Huppertsberg ..... 182/3
4,907,972 A 3/1990 Marolda
4,922,860 A 5/1990 Hutchings
4,981,110 A 1/1991 Llewellyn
5,074,795 A 12/1991 Clark
5,080,191 A 1/1992 Sanchez
5,120,287 A 6/1992 Brown et al.
5,220,976 A 6/1993 Gunter
5,226,820 A 7/1993 Pearson
5,289,896 A 3/1994 Giglio
5,388,551 A 2/1995 Martusciello
5,435,272 A 7/1995 Epstein
5,476,070 A 12/1995 Gwon et al.
5,540,188 A 7/1996 Heinrichs
5,619,955 A 4/1997 Nelson
5,634,439 A 6/1997 O'Brien
5,699,555 A 12/1997 Schunter
5,766,114 A 6/1998 Campbell
6,125,792 A 10/2000 Gee
6,311,884 B1 11/2001 Johnson
6,325,023 B1 12/2001 Elnatan
6,338,699 B1 1/2002 Veitch
6,361,478 B1 3/2002 Giancaspro
6,397,389 B1 6/2002 Schultz
6,827,672 B2 12/2004 Miceli (Continued)

OTHER PUBLICATIONS

Ski Trainer, http://luckybums.com/skitrainer.aspx, retrieved Nov. 10, 2010.

(Continued)

*Primary Examiner* — Rob Swiatek
*Assistant Examiner* — Ebony Evans
(74) *Attorney, Agent, or Firm* — Buchanan Nipper LLC

(57) ABSTRACT

A harness for wearing by a first person. The harness having a handle for grasping by a second person.

20 Claims, 6 Drawing Sheets

U.S. PATENT DOCUMENTS

| | | | | |
|---|---|---|---|---|
| 6,968,809 | B2 | 11/2005 | Reardon | |
| 7,225,472 | B2 | 6/2007 | McDonald, Jr. et al. | |
| 7,267,080 | B2 | 9/2007 | Gallo et al. | |
| 7,341,025 | B1 | 3/2008 | Streeter et al. | |
| 8,147,252 | B1 * | 4/2012 | Stanford et al. | 434/255 |
| 2004/0058598 | A1 | 3/2004 | Miller | |
| 2006/0032703 | A1 * | 2/2006 | Burdet | 182/3 |
| 2008/0018163 | A1 | 1/2008 | Winn et al. | |

OTHER PUBLICATIONS

Lucky Bums Grip 'n. Guide Sports Harness, http://www.amazon.com/lucky-bums-guide-sports-harness/dp/b000nz6dgc/ref=pd_sbs_sg_5, retrieved Mar. 1, 2010.

Kids Ski Harness, http://www.amazon.com/kids-ski-harness/dp/b001n0s5bm, retrieved Mar. 1, 2010.

* cited by examiner

HARNESS

PRIORITY/CROSS-REFERENCE TO RELATED APPLICATIONS

This application claims the benefit of U.S. Provisional Application No. 61/307,565, filed Feb. 24, 2010, the disclosure of which is incorporated by reference.

TECHNICAL FIELD

The disclosure generally relates to the field of appliances worn by humans. Exemplary embodiments relate to appliances worn by a first human that enables a second human to help stabilize or balance the first human.

BACKGROUND

There are many circumstances when a first human will help stabilize a second human's body. For instance, during physical therapy, while learning to ride a bike, etc.

Exemplary embodiments are directed to harnesses worn by a child desiring to learn how to ride a bicycle or other piece of sports equipment. Such sports equipment including, but not limited to, bicycles, scooters, roller skates, inline skates, skis, snowboards, skateboard, and ice skates. The most typical way for a child to learn to ride a bicycle is through use of "training wheels" attached to the rearward portion of the bicycle, these training wheels helping to prevent the bicycle from tipping over as the child loses balance. However, for many children, the training wheels become an impediment to being able to quickly learn how to ride the bicycle as they come to rely on the training wheels as merely additional wheels instead of as a safety means. Another way for child to learn to ride a piece of sports equipment is through a parent jogging along side the sports equipment, helping to balance it as necessary as the child learns how to balance the sports equipment his/herself.

SUMMARY OF THE DISCLOSURE

Several exemplary harnesses are described herein, including a harness for wearing by a child, the harness having a handle for grasping by an adult. The harness assisting the child in attaining proficiency and skill by allowing the adult to be positively in control of the child's torso and help to provide balance without interfering with the sports equipment. The harness allowing the parent to have a more appropriate posture while helping to balance the child on the sports equipment. The harness also providing additional safety without being an actual safety harness, helping to prevent injury of both the parent and child (e.g., back injuries, injuries from falling).

An exemplary harness comprises a plate, a handle, a lumbar strap, a chest strap, a first shoulder strap, and a second shoulder strap.

Another exemplary harness comprises a plate, a handle, a lumbar strap, a chest strap, a first shoulder strap, and a second shoulder strap. The plate defines at least one chest strap connector for connecting with the chest strap. The plate defines at least one first shoulder strap connector for connecting with the first shoulder strap. The plate defines at least one second shoulder strap connector for connecting with the second shoulder strap. The plate defines at least one handle connector for connecting with the handle. The handle is for grasping by a non-wearer of the harness. The handle configured for connection with the plate at the handle connector. The lumbar strap is for strapping around the lower back of a wearer of the harness. The lumbar strap has a lumbar strap first end extending to a lumbar strap second end. The lumbar strap has a center portion generally between the lumbar strap first end and the lumbar strap second end. The lumbar strap first end comprises a lumbar strap first buckle. The lumbar strap second end comprises a lumbar strap second buckle. The lumbar strap first buckle and the lumbar strap second buckle can connect with one another. The chest strap is for strapping around the chest of a wearer of the harness. The chest strap has a chest strap first end extending to a chest strap second end. The chest strap first end comprises a chest strap first buckle. The chest strap second end comprises a chest strap second buckle. The chest strap first buckle and the chest strap second buckle can connect with one another. The first shoulder strap is for strapping over a first shoulder a wearer of the harness. The first shoulder strap has a first shoulder strap first end extending to a first shoulder strap second end. The first shoulder strap first end connects with the lumbar strap adjacent the lumbar strap first end. The first shoulder strap second end connects with the lumbar strap adjacent the lumbar strap center portion. The second shoulder strap is for strapping over a second shoulder a wearer of the harness. The second shoulder strap has a second shoulder strap first end extending to a second shoulder second end. The second shoulder first end connects with the lumbar strap adjacent the lumbar strap second end. The second shoulder strap second end connect with the lumbar strap adjacent the lumbar strap center portion.

Another exemplary harness comprises a plate, a handle, a lumbar strap, a chest strap, a first shoulder strap, and a second shoulder strap. The plate defines at least one chest strap connector for connecting with the chest strap. The plate defines at least one first shoulder strap connector for connecting with the first shoulder strap. The plate defines at least one second shoulder strap connector for connecting with the second shoulder strap. The plate defines at least one handle connector for connecting with the handle. The handle is for grasping by a non-wearer of the harness and can connect with the plate at the handle connector. The lumbar strap is for strapping around the lower back of a wearer of the harness. The lumbar strap has a lumbar strap first end extending to a lumbar strap second end. The lumbar strap has a center portion generally between the lumbar strap first end and the lumbar strap second end. The lumbar strap first end has a lumbar strap first buckle. The lumbar strap second end has a lumbar strap second buckle. The lumbar strap first buckle and the lumbar strap second buckle can connect with one another. The lumbar strap first buckle and the lumbar strap second buckle are preferably adjustable buckles. The chest strap is for strapping around the chest of a wearer of the harness. The chest strap has a chest strap first end extending to a chest strap second end. The chest strap first end has a chest strap first buckle, and the chest strap second end has a chest strap second buckle. The chest strap first buckle and the chest strap second buckle can connect with one another. The chest strap first buckle and the chest strap second buckle are preferably adjustable buckles. The first shoulder strap is for strapping over a first shoulder a wearer of the harness. The first shoulder strap has a first shoulder strap first end that extending to a first shoulder strap second end. The first shoulder strap first end connects with the lumbar strap adjacent the lumbar strap first end. The first shoulder strap second end connects with the lumbar strap adjacent the lumbar strap center portion. The second shoulder strap is for strapping over a second shoulder a wearer of the harness. The second shoulder strap has a second shoulder strap first end extending to a second shoulder second end. The second shoulder first end connects with the lumbar strap adjacent the lumbar strap second end. The second shoulder strap second end connects with the lumbar strap adjacent the lumbar strap center portion. A first leg strap is provided for strapping around a first leg of a wearer of the harness, and a second leg strap is provided for strapping around a second leg of a wearer of the harness. The first leg strap and the second leg strap preferably attach to the lumbar strap. The first leg strap has a first leg strap first end extending to a first leg strap second end. The first leg strap first end has a first leg strap first buckle. The first leg strap first buckle and the first leg strap second end can connect with one another. The second leg strap has a second leg strap first end extending to a second leg strap second end. The second leg strap first end has a second leg strap first buckle. The second leg strap first buckle and the second leg strap second end can connect with one another.

Another exemplary harness comprises a plate, a handle, a lumbar strap, a chest strap, a first shoulder strap, and a second shoulder strap. The plate has a center point. The plate has a pair of chest strap connectors for connecting with the chest strap, the chest strap connectors are spaced apart from one another with the center point located there-between. The plate has a pair of first shoulder strap connectors for connecting with the first shoulder strap, the first shoulder strap connectors are spaced apart from one another with the center point located there-between. The plate has a pair of second shoulder strap connectors for connecting with the second shoulder strap, the second shoulder strap connectors are spaced apart from one another with the center point located there-between. The plate has a pair of handle connectors for connecting with the handle, the handle connectors are spaced apart from one another with the center point located there-between. The handle is for grasping by a non-wearer of the harness. The handle has a handle strap. The handle strap connects with the handle connectors. The lumbar strap is for strapping around the lower back of a wearer of the harness. The lumbar strap has a lumbar strap first end extending to a lumbar strap second end. The lumbar strap has a center portion generally between the lumbar strap first end and the lumbar strap second end. The chest strap is for strapping around the chest of a wearer of the harness. The chest strap has a chest strap first end that extends to a chest strap second end, the chest strap connecting with the chest strap connectors. The first shoulder strap is for strapping over a first shoulder a wearer of the harness. The first shoulder strap has a first shoulder strap first end extending to a first shoulder strap second end. The first shoulder strap first end connects with the lumbar strap adjacent the lumbar strap first end. The first shoulder strap second end connects with the lumbar strap adjacent the lumbar strap center portion. The first shoulder strap connects with the first shoulder strap connectors. The second shoulder strap is for strapping over a second shoulder a wearer of the harness. The second shoulder strap has a second shoulder strap first end extending to a second shoulder second end. The second shoulder first end connects with the lumbar strap adjacent the lumbar strap second end. The second shoulder strap second end connects with the lumbar strap adjacent the lumbar strap center portion. The second shoulder strap connects with the second shoulder strap connector. The handle strap, chest strap, first shoulder strap and second shoulder strap cross one another.

Additional understanding of the devices and methods contemplated and/or claimed by the inventor(s) can be gained by reviewing the detailed description of exemplary devices and methods, presented below, and the referenced drawings.

DETAILED DESCRIPTION OF THE EXEMPLARY EMBODIMENTS

Figure 1:
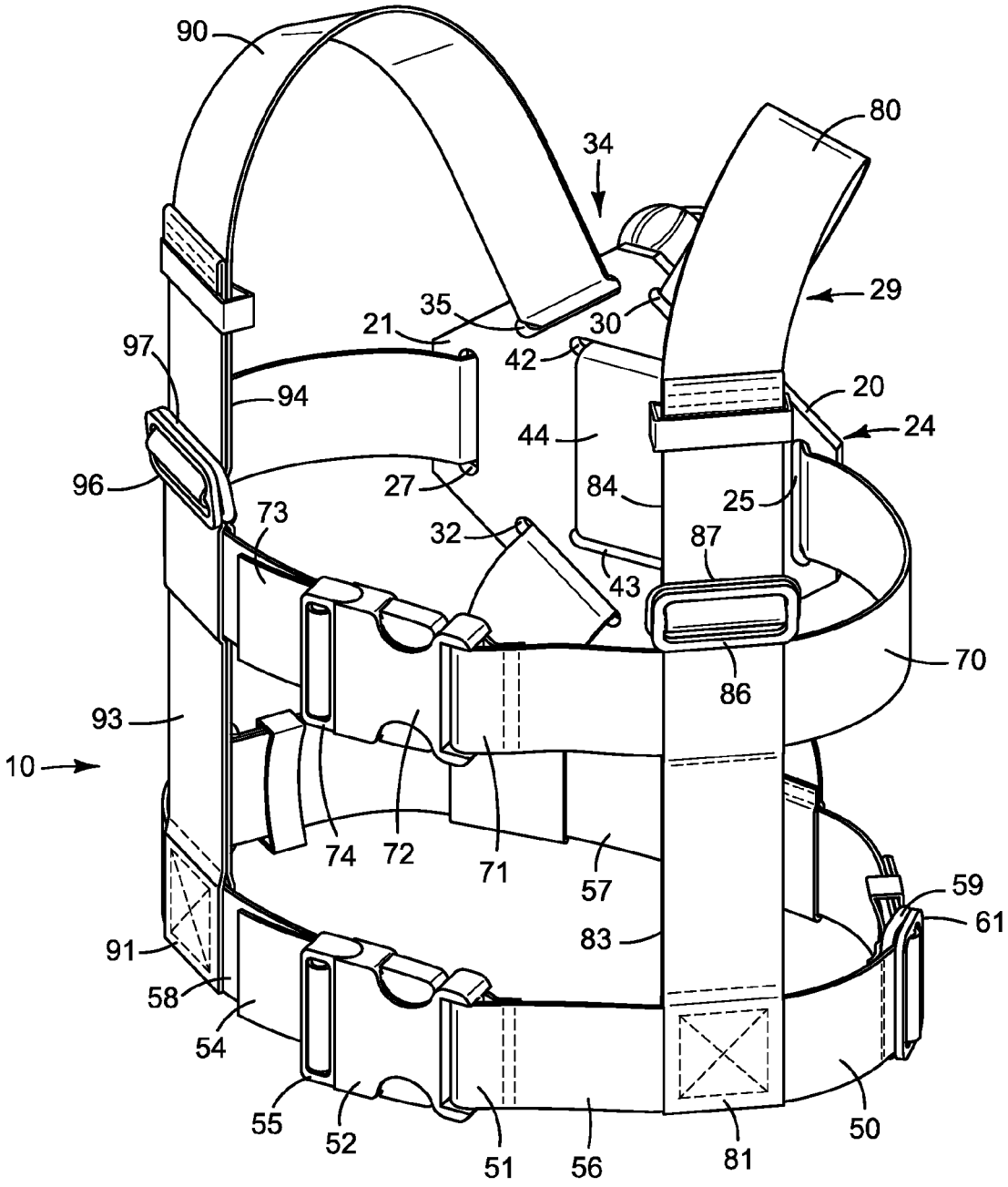
FIG. 1 is a front-right side perspective view of a first illustrated embodiment.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific forms disclosed. On the contrary, the presently disclosed and claimed inventive concept(s) is to cover all modifications, alternative constructions, and equivalents falling within the spirit and scope of the inventive concept(s) as defined in the claims.

The following description and the referenced drawings provide illustrative examples of that which the inventor regards as his invention. As such, the embodiments discussed herein are merely exemplary in nature and are not intended to limit the scope of the invention, or its protection, in any manner. Rather, the description and illustration of these embodiments serve to enable a person of ordinary skill in the relevant art to practice the invention.

The use of "e.g.," "etc," "for instance," "in example," and "or" and grammatically related terms indicates non-exclusive alternatives without limitation, unless otherwise noted. The use of "including" and grammatically related terms means "including, but not limited to," unless otherwise noted. The use of the articles "a," "an" and "the" are meant to be interpreted as referring to the singular as well as the plural, unless the context clearly dictates otherwise. Thus, for example, reference to "a strap" includes two or more such straps, and the like. The use of "exemplary" means "an example of" and is not intended to convey a meaning of an ideal or preferred embodiment.

The use of "sports equipment" is intended to generally refer to sports equipment worn or ridden by an individual (e.g., bicycles, scooters, roller skates, inline skates, skis, snowboards, skateboard, ice skates).

FIG. 1 through FIG. 5 show a first exemplary harness. FIG. 6 shows a second exemplary harness.

Referring initially to FIGS. 1 through 5, illustrated is a harness 10 comprising a plate 20, a handle 41, a lumbar strap 50, a chest strap 70, a first shoulder strap 80, and a second shoulder strap 90.

The plate 20 preferably has a first side 21 opposite a second side 23 defining a thickness there-between. In the embodiment illustrated in FIG. 1, the plate 20 is octagonal-shaped. When worn, the plate 20 is located on the back of the wearer. The plate 20 keeps everything together provides for a focal point of the tension in the harness 10.

The plate 20 preferably defines at least one chest strap connector 24 for connecting with the chest strap 70. It is preferred that the chest strap connector 24 comprise at least one slot defined through the thickness of the plate 20. In the embodiment illustrated in FIG. 1, the chest strap connector 24 comprises a pair of slots defined through the thickness of the plate 20, namely a first chest strap slot 25 and a second chest strap slot 27. The first chest strap slot 25 having a center 26. The second chest strap slot 27 having a center 28. Preferably, the first chest strap slot 25 and the second chest strap slot 27 are generally parallel to one another. When property fitted on a wearer, the plate 20 should sit between the shoulder blades or just below the mid scapular region.

The plate 20 preferably also defines at least one first shoulder strap connector 29 for connecting with the first shoulder strap and at least one second shoulder strap connector 34 for connecting with the second shoulder strap 90.

The first shoulder strap connector 29 having at least one slot defined through the thickness of the plate 20. In the embodiment illustrated in FIG. 1 through FIG. 5, the first shoulder strap connector 29 has two slots, namely a first upper shoulder strap slot 30 and a first lower shoulder strap slot 32. The first upper shoulder strap slot 30 having a center 31. The first lower shoulder strap slot 32 having a center 33. It is preferred that the first upper strap slot 30 and the first lower shoulder strap slot 32 be generally parallel to one another.

The second shoulder strap connector 34 having at least one slot defined through the thickness of the plate 20. In the embodiment illustrated in FIG. 1 through FIG. 5, the second shoulder strap connector 34 has two slots, namely a second upper shoulder strap slot 35 and a second lower shoulder strap slot 37. The second upper shoulder strap slot 35 having a center 36. The second lower shoulder strap slot 37 having a center 38. Preferably, the second upper strap slot 35 and the second lower shoulder strap slot 37 are generally parallel to one another.

The plate 20 having a center point 39, shown in FIG. 6. The usage of the term "point" not intended to be limited to a finite point on the plate, for instance, it can include the an area of the plate. Nor is the usage of the term "center" intended to represent the actual "center" of the plate, for instance, it can include any portion of the plate spaced from the edges of the plate.

Preferably, the first chest strap slot center 26 and the second chest strap slot center 28 are equidistant from the center point 39. Preferably, the first upper shoulder strap slot center 31 and the first lower shoulder strap slot center 33 are equidistant from the center point 39. Preferably, the second upper shoulder strap slot center 36 and the second lower shoulder strap slot center 33 are equidistant from the center point 39. Preferably, the first chest strap slot center 26, the second chest strap slot center 28, the first upper shoulder strap slot center 31, the first lower shoulder strap slot center 33, the second upper shoulder strap slot center 36, and the second lower shoulder strap slot center 33 are spaced generally sixty degrees apart from one another.

Figure 2:
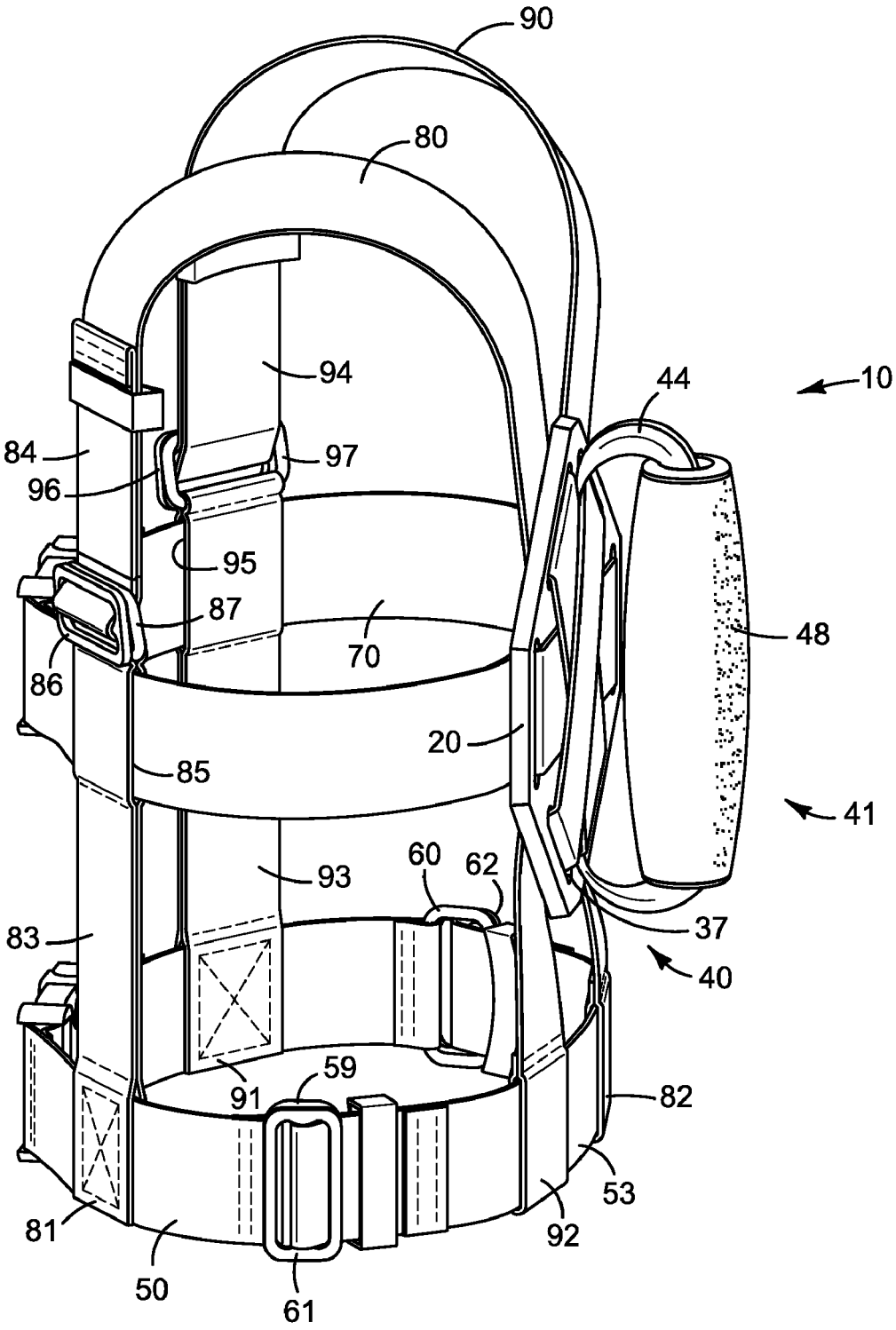
FIG. 2 is a rear-right side perspective view of the embodiment of FIG. 1.
Figure 3:
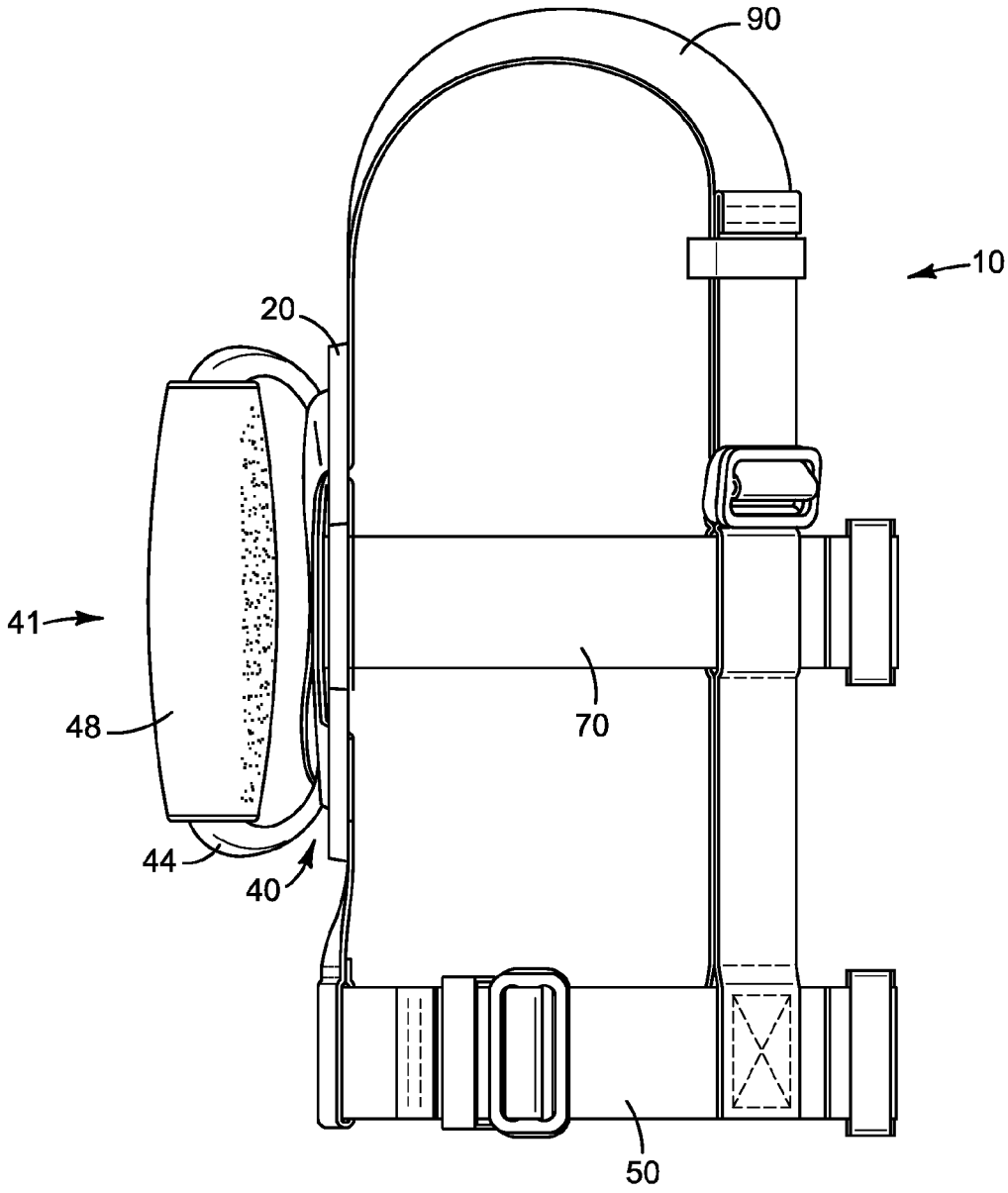
FIG. 3 is a left side view of the embodiment of FIG. 1.
Figure 4:
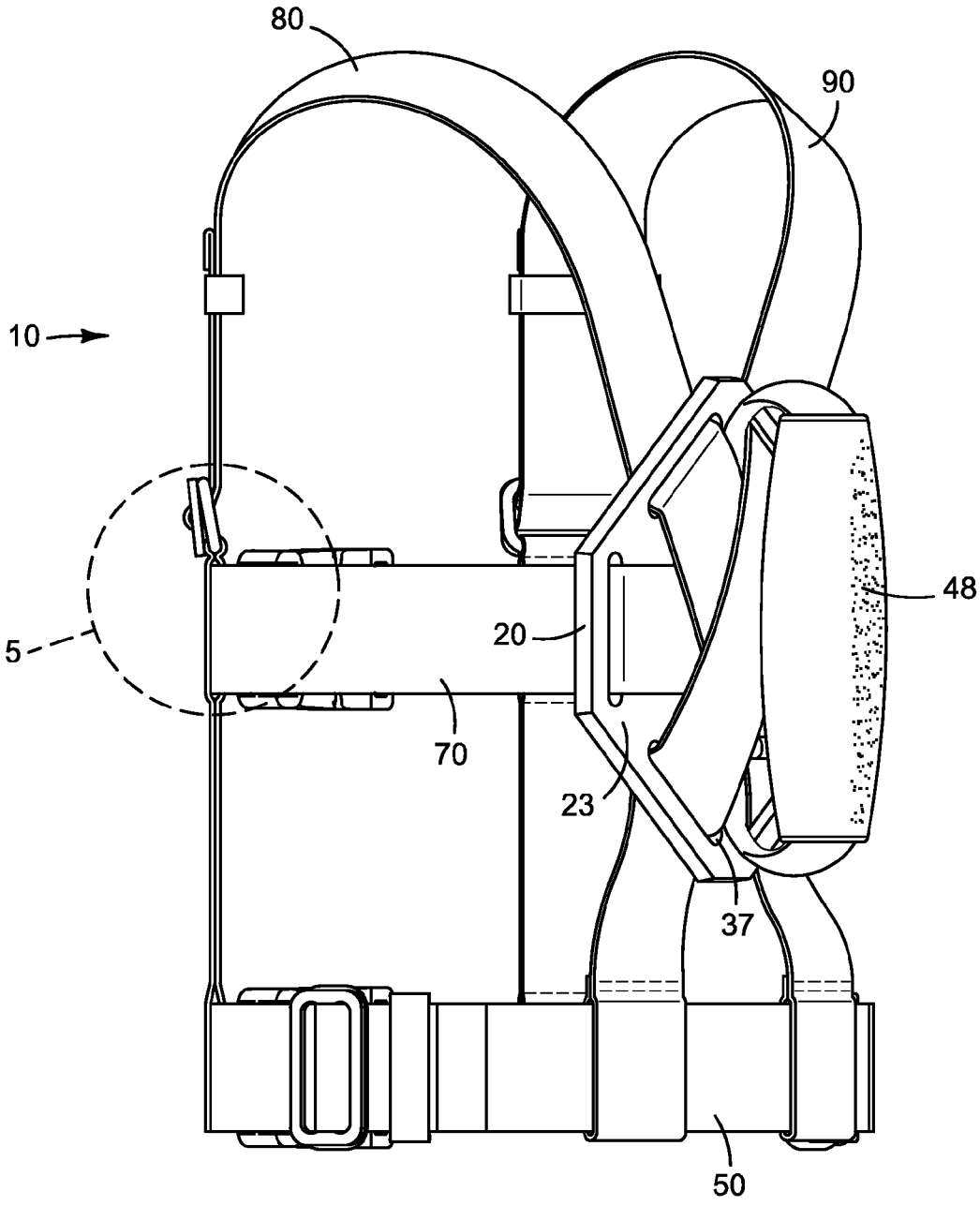
FIG. 4 is a rear-right side view of the embodiment of FIG. 1.
Figure 5:
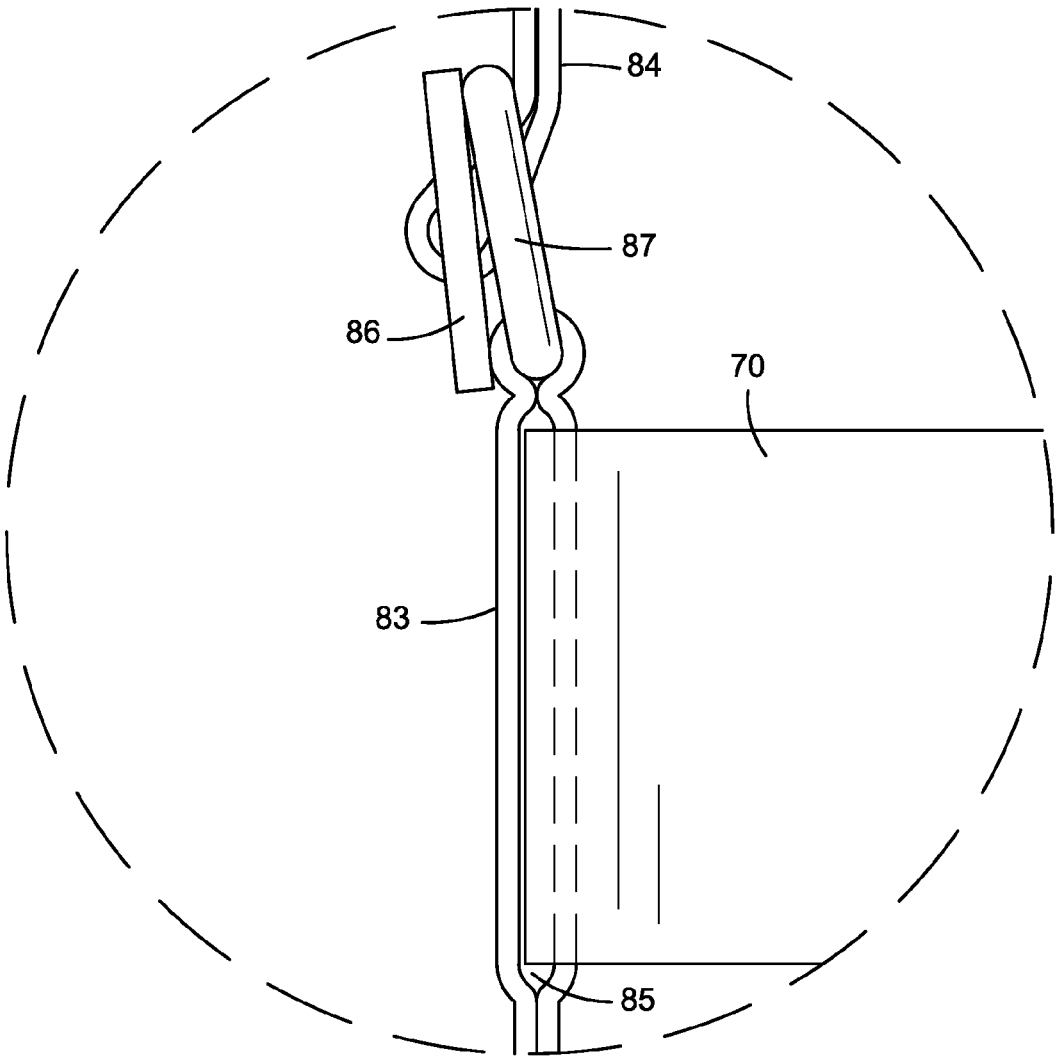
FIG. 5 is a detail view of a portion of FIG. 4.
Figure 6:
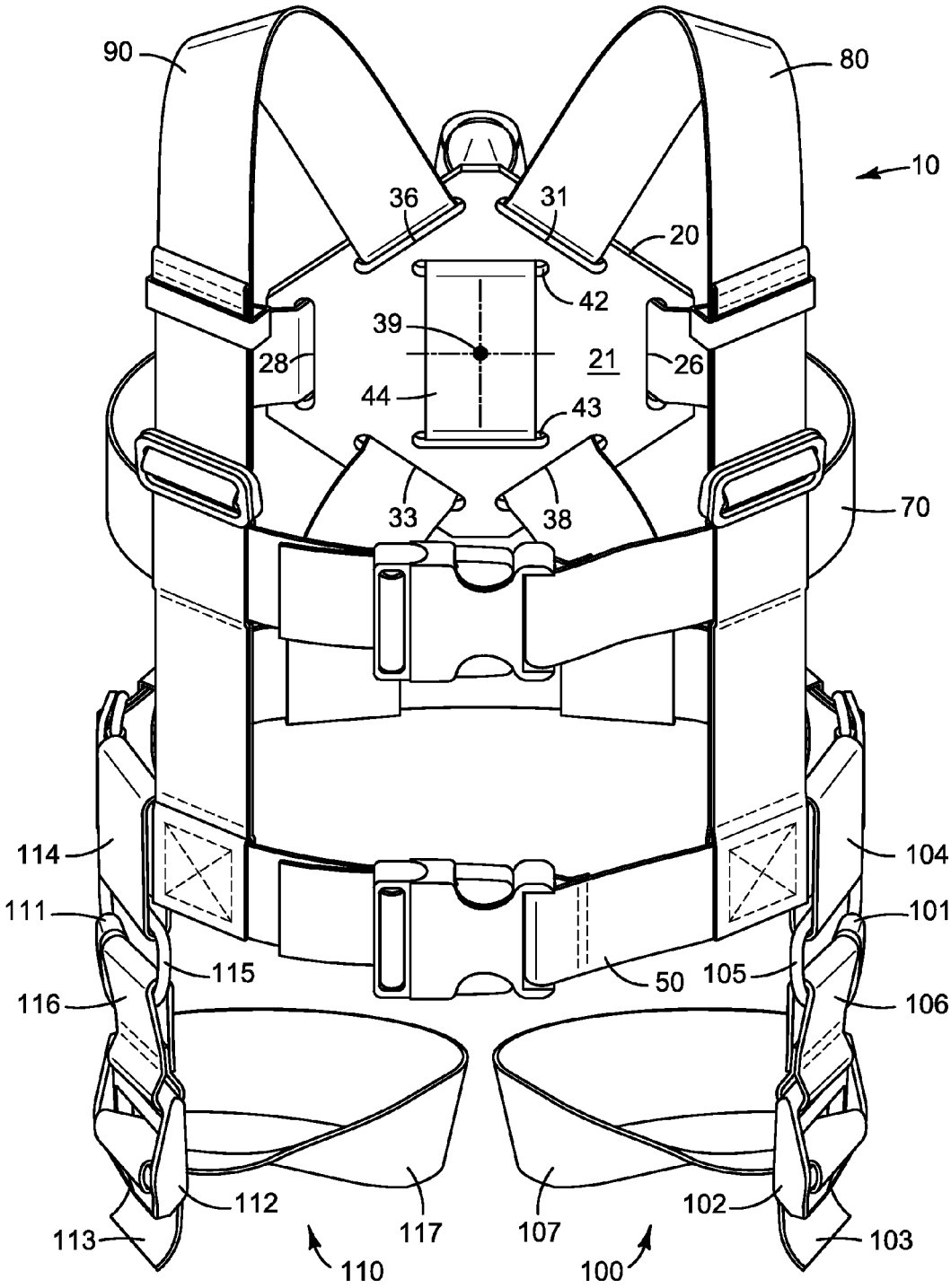
FIG. 6 is a front side, perspective view of a second illustrated embodiment.

Referring back to the embodiment illustrated in FIG. 1 though FIG. 5, particularly FIG. 2 and FIG. 3, the plate 20 preferably defines at least one handle connector 40 for connecting with the handle 41. The handle connector 40 comprising a handle strap slot 42 defined through the plate 20 thickness and a second handle strap slot 43 defined through the plate 20 thickness. Preferably, the first handle strap slot 42 and the second handle strap slot 43 generally parallel to one another and are spaced equidistant from the center point 39 of the plate 20.

The handle 41 is configured for grasping by a non-wearer of the harness 10. The handle 41 is configured for connection with the plate 20 at the handle connector 40. In the embodiment illustrated in FIG. 1 through FIG. 6, the handle 41 preferably comprising at least one handle strap 44 which extends through the first handle strap slot 42 and second handle strap slot 43.

The handle strap 44 comprising a hand-hold 48. In the illustrated embodiment, the hand-hold 48 comprising a plastic, rubber or poly-resin tubular portion that may have a foam grip or other gripping material (e.g., rubber) exterior. The handle strap 44 extends through the hand-hold 48. The handle strap 44 having a first end and a second end. The first handle strap end and the second handle strap end are configured for connecting together to form a handle strap loop, e.g., by sewing, bonding, adhesives, welds, fasteners. It is preferred that the handle be oriented vertically, as shown in FIG. 1 through FIG. 6.

The lumbar strap 50 is for strapping around the lower back of a wearer of the harness 10. The lumbar strap 50 has a first end 51 extending to a second end 52. The lumbar strap 50 has a center portion 53 generally between the first end 51 and the second end 52.

The first end 51 has a first buckle 52. The second end 54 comprising a second buckle 55. The first buckle 52 and the second buckle 55 configured for connection with one another, preferably a releasable connection. The preferred buckle style is commonly known as a "side release buckle." It is preferred that the first buckle 52 and the second buckle 55 are adjustable buckles, able to adjust the length of the lumbar strap 50 for a more secure fit on the wearer. It is preferred that the first buckle 52 and second buckle 55 be made of plastic, e.g., nylon.

In the embodiment illustrated in the drawings, the lumbar strap 50 comprises three segments, namely a first segment 56, a second segment 57 and a third segment 58. The first segment 56 extending between the first buckle 52 and a first loop 59. The loop 59 preferably a loop or ring made of metal or plastic. The third segment 58 extending between the second slide buckle 61 and a second loop 60. The loop 60 preferably a loop or ring made of metal or plastic. The second slide buckle 61 resting against the first loop 59 when tension is applied to the harness 10 and the first slide buckle 62 resting against the second loop 60 when tension is applied to the harness 10.

The second segment 57 extending between a first slide buckle 61 and a second slide buckle 62. The slide buckles are preferably made from plastic (e.g., nylon) or metal. The second segment 57 preferably has a first end that extends through the first loop 59 to the first slide buckle 61, and a second end that extends through the second loop 60 to the second slide buckle 62. In such a configuration, the lumbar strap 50 can have its length changed to accommodate varying sizes of users.

The chest strap 70 is for strapping around the chest of a wearer of the harness 10, providing a firm fit to the chest. The chest strap 70 having a first end 71 extending to a second end 73. The first end 71 has a first buckle 72. The second end 73 comprising a second buckle 74. The first buckle 72 and the second buckle 74 are preferably configured for connection with one another, wherein the first buckle 72 and the second buckle 74 are adjustable buckles.

The first shoulder strap 80 is for strapping over a first shoulder a wearer of the harness 10. The first shoulder strap 80 having a first shoulder strap first end 81 extending to a first shoulder strap second end 82. In the embodiment illustrated in the Figures, the first shoulder strap first end 81 connects with the lumbar strap 50 adjacent the lumbar strap first end 51, and the first shoulder strap second end 82 connects with the lumbar strap 50 adjacent the lumbar strap center portion 53. Preferably, the first shoulder strap first end 81 is fixed to the lumbar strap 50, for instance through use of sewing, fasteners, adhesives, or welds. Preferably, the first shoulder strap second end 82 is slidably connected to the lumbar strap 50, allowing the second end 82 to slide side-to-side to allow for a better more custom fit.

The first shoulder strap 80 preferably comprises two segments, namely a first segment 83, and a second segment 84.

The first segment 83 extending between the lumbar strap 50 and loop 87. It is preferred that the first segment 83 be fixed to the lumbar strap 50 adjacent the first end 51, for instance through use of sewing, fasteners, adhesives or welds.

The first segment 83 comprising a double row of webbing sewn together from the connection with the lumbar strap 50 until adjacent the chest strap 70. At the chest strap 70 area, the double row of webbing is not sewn together over a 1.50 inch to 2.00 inch section, thereby defining a first shoulder strap slot 85 there-between configured for the chest strap 70 to pass through.

The second segment 84 extending between the lumbar strap 50 and a slide buckle 86. It is preferred that the second segment 84 connect with the lumbar strap 50 adjacent the center portion 53, as described above. Preferably, the second segment 84 extends through the loop 87 to the slide buckle 86, as particularly shown in FIG. 5. The slide buckle 86 resting against the loop 87 when tension is applied to the harness 10.

Such a configuration allowing the length of the first shoulder strap 80 to be adjusted to better fit the wearer of the harness 10.

It is further preferred that the chest strap 70 laterally connect with the first shoulder strap 80. For instance, as shown particularly in FIG. 5, the first shoulder strap 80 defining a slot 85 through which the chest strap 70 passes and is free to slide through. It is preferred that the first shoulder strap 80 be sewn above and below the slot 85 to provide a guide path for the chest strap 70.

The second shoulder strap 90 is for strapping over a second shoulder a wearer of the harness 10. The second shoulder strap 90 having a second shoulder strap first end 91 extending to a second shoulder strap second end 92. In the embodiment illustrated in the Figures, the second shoulder strap first end 91 connects with the lumbar strap 50 adjacent the lumbar strap second end 54, and the second shoulder strap second end 92 connects with the lumbar strap 50 adjacent the lumbar strap center portion 53. Preferably, the second shoulder strap first end 91 is fixed to the lumbar strap 50, for instance through use of sewing, fasteners, adhesives, or welds. Preferably, the second shoulder strap second end 92 is slidably connected to the lumbar strap 50, allowing the second end 92 to slide side-to-side to allow for a better more custom fit.

The second shoulder strap 90 preferably comprises two segments, namely a first segment 93, and a second segment 94. The first segment 93 extending between the lumbar strap 50 and loop 97. It is preferred that the first segment 93 be fixed to the lumbar strap 50 adjacent the second end 54, for instance through use of sewing, fasteners, adhesives or welds.

The second segment 93 comprising a double row of webbing sewn together from the connection with the lumbar strap 50 until adjacent the chest strap 70. At the chest strap 70 area, the double row of webbing is not sewn together over a 1.50 inch to 2.00 inch section, thereby defining a second shoulder strap slot 95 there-between configured for the chest strap 70 to pass through.

The second segment 94 extending between the lumbar strap 50 and a slide buckle 96. It is preferred that the second segment 94 connect with the lumbar strap 50 adjacent the center portion 53, as described above. Preferably, the second segment 94 extends through the loop 97 to the slide buckle 96. Such a configuration allowing the length of the first shoulder strap 90 to be adjusted to better fit the wearer of the harness 10. The slide buckle 96 resting against the loop 97 when tension is applied to the harness 10.

It is further preferred that the chest strap 70 laterally connect with the second shoulder strap 90. For instance, as shown in the Figures, the second shoulder strap 90 defining a slot 87 through which the chest strap 70 passes and is free to slide through. It is preferred that the second shoulder strap 90 be sewn above and below the slot 87 to provide a guide path for the chest strap 70. When worn, the chest strap 70 would encircle the wearer's chest, below the shoulders and above the waist.

Referring particularly to FIG. 2, this illustrated configuration results in the chest strap 70, the first shoulder strap 80 and the second shoulder strap 90 crossing adjacent the plate center point 39 on the plate second side 23. On the plate first side 21, as best can be seen in FIG. 6, the handle strap 44 crosses the plate center point 39, resulting in the plate 20 being held between the chest strap/first shoulder strap/second shoulder strap and the handle strap 44.

Referring now to FIG. 6, shown is the second exemplary harness. This embodiment the same as the first except for provision of optional leg straps. This Figure illustrates the harness 10 having a plate 20, a handle 41, a lumbar strap 50, a chest strap 70, a first shoulder strap 80, a second shoulder strap 90, a first leg strap 100 and a second leg strap 110.

The first leg strap 100 connects to the harness 10 via a connector 104, whereas the second leg strap 110 connects to the harness 10 via a connector 114. Connector 104 and connector 114 comprising loops of webbing able to slide along the lumbar strap 50. The connectors (104, 114) could otherwise attach to the lumbar strap 50, for instance via sewing, adhesives, welding, fasteners, etc.

In the embodiment shown in the Figure, the connector 104 has a d-ring 105 extending there-from and the connector 114 has a d-ring 115 extending there-from.

It is preferred that the first leg strap 100 comprise a first segment 106 and a second segment 107. The first segment 106 fixedly attached to the d-ring 105, for instance by the first end of the first segment 106 looping through the d-ring and being fixed to itself by sewing, adhesives, welding, fasteners or other means. The first segment 106 can also connect with a buckle 102 at a first segment second end. A preferred buckle 102 is a plastic strap adjuster.

The second segment 107 having a first end 101 attached to the d-ring 105, for instance by the first end 101 of the second segment 107 looping through the d-ring and being fixed to itself by sewing, adhesives, welding, fasteners or other means. The second segment 107 extending to a second end 103 that is configured for engaging the buckle 102 to allow the first leg strap to encircle a first leg of a wearer, and allowing the first leg strap to be adjustable.

It is preferred that the second leg strap 110 comprise a first segment 116 and a second segment 117. The first segment 116 fixedly attached to the d-ring 115, for instance by the first end of the first segment 116 looping through the d-ring and being fixed to itself by sewing, adhesives, welding, fasteners or other means. The first segment 116 can connect with a buckle 112 at a first segment second end. A preferred buckle 112 is a plastic strap adjuster.

The second segment 117 having a first end 111 attached to the d-ring 115, for instance by the first end 111 of the second segment 117 looping through the d-ring and being fixed to itself by sewing, adhesives, welding, fasteners or other means. The second segment 117 extending to a second end 113 that is configured for engaging the buckle 112 to allow the second leg strap to encircle a second leg of a wearer, and allowing the second leg strap to be adjustable.

Attachment of the leg straps can also be accomplished by other types of fasteners and attachment means, including, but not limited to snaps and hook-and-loop (e.g., VELCRO®) fasteners. For instance, in one exemplary embodiment, a hook-and-loop attachment is used, consisting of a triple layer of hook-and-loop with a piece from the left, then a piece from the right, then a piece again on top from the left. The leg straps would consist of a d-ring with the triple layer of hook-and-loop along the flat side of the d-ring and adjustable leg straps coming off the curved portion of the d-ring. A fixed portion with one-half of the plastic buckle, preferably the female portion, could be attached to a strap sewn to the d-ring with an extra piece of nylon or polypropylene material that lays under the buckle along the leg for protection/comfort and to keep a wearer from getting pinched when connecting the buckle. Another strap comes from the d-ring next to the previous one and will end in an adjustable plastic buckle, preferably the male portion, and will have a keeper that the adjustable strap feeds through and the strap will be sewn back onto itself to prevent coming out of the keeper.

It is preferred that the plate 20 be made from a stiff material, e.g. polyurethane or other plastics, rubber, metal, ceramic, wood. Loops and d-rings are preferably made from metal, but other materials, including plastics, can be used. Strap adjusters and slide buckles are preferably made from plastic (e.g., nylon), but other materials, including metals, can be used. All side release buckles are preferably made from plastic (e.g., nylon). All straps can be made from nylon webbing, however, other materials may also be used.

A vertical handle configuration allows more major muscle groups of the person holding the handle to be recruited to control the wearer, such as the lattisimus dorsi, trapezious, rhomboids, and the deltoids, as well as the subscapularis, and teres muscles. This is safer for the wearer as the controller of the handle is less likely to drop them or loose control of them. Handles with horizontal handles utilize more forearm and biceps muscle groups as well as some deltoid involvement. A person holding such a handle is more likely to injure themselves in this position due to the over all weakness of the arm compared to the back muscles.

This overall design allows for the person holding the handle to be in active control of the tension created by the lumbar, chest and shoulder straps crossing and thus allows for control of the person in the harness. The combination of the placement of the handle, plate, and the lumbar, chest and shoulder straps allows for active control of the tension on the straps and allows the person holding the handle to more safely and more effectively, support, manipulate, and maneuver the wearer of the harness with out injury to themselves or the wearer.

The position and location of the handle and plate also allows the controller (handle holder) of the harness to be able to be in a full upright position when walking or running along side the wearer of the harness and still be in control as needed. This prevents the bending over needed with many other harness systems and allows for less back pain in the handle holder.

The foregoing detailed description provides exemplary embodiments of the invention and includes the best mode for practicing the invention. The description and illustration of these embodiments is intended only to provide examples of the invention, and not to limit the scope of the invention, or its protection, in any manner.

What is claimed:

1. A harness, said harness comprising:

a plate, a handle, a lumbar strap, a chest strap, a first shoulder strap, and a second shoulder strap;

said plate defining having a center point;

said plate defining a pair of chest strap connectors for connecting with said chest strap, said chest strap connectors spaced apart from one another with said center point located there-between;

said plate defining a pair of first shoulder strap connectors for connecting with said first shoulder strap, said first shoulder strap connectors spaced apart from one another with said center point located there-between;

said plate defining a pair of second shoulder strap connectors for connecting with said second shoulder strap, said second shoulder strap connectors spaced apart from one another with said center point located there-between;

said plate defining a pair of handle connectors for connecting with said handle, said handle connectors spaced apart from one another with said center point located there-between;

said handle for grasping by a non-wearer of said harness, said handle comprising a handle strap, said handle strap connecting with said handle connectors;

said lumbar strap for strapping around the lower back of a wearer of said harness, said lumbar strap having a lumbar strap first end extending to a lumbar strap second end, said lumbar strap having a center portion generally between said lumbar strap first end and said lumbar strap second end;

said chest strap for strapping around the chest of a wearer of said harness, said chest strap having a chest strap first end extending to a chest strap second end, said chest strap connecting with said chest strap connectors;

said first shoulder strap for strapping over a first shoulder a wearer of said harness, said first shoulder strap having a first shoulder strap first end extending to a first shoulder strap second end, said first shoulder strap first end connecting with said lumbar strap adjacent said lumbar strap first end, said first shoulder strap second end connecting with said lumbar strap adjacent said lumbar strap center portion, said first shoulder strap connecting with said first shoulder strap connectors; and said second shoulder strap for strapping over a second shoulder a wearer of said harness, said second shoulder strap having a second shoulder strap first end extending to a second shoulder second end, said second shoulder first end connecting with said lumbar strap adjacent said lumbar strap second end, said second shoulder strap second end connecting with said lumbar strap adjacent said lumbar strap center portion, said second shoulder strap connecting with said second shoulder strap connector; and wherein the handle strap, chest strap, first shoulder strap and second shoulder strap cross one another.

2. A harness, said harness comprising:

a plate, a handle, a lumbar strap, a chest strap, a first shoulder strap, and a second shoulder strap;

said plate defining at least one chest strap connector for connecting with said chest strap, said plate defining at least one first shoulder strap connector for connecting with said first shoulder strap, said plate defining at least one second shoulder strap connector for connecting with said second shoulder strap, said plate defining at least one handle connector for connecting with said handle each of said shoulder strap connectors being separate from each other;

said handle for grasping by a non-wearer of said harness, said handle configured for connection with said plate at said handle connector;

said lumbar strap for strapping around the lower back of a wearer of said harness, said lumbar strap having a lumbar strap first end extending to a lumbar strap second end, said lumbar strap having a center portion generally between said lumbar strap first end and said lumbar strap second end;

said chest strap for strapping around the chest of a wearer of said harness, said chest strap having a chest strap first end extending to a chest strap second end;

said first shoulder strap for strapping over a first shoulder of a wearer of said harness, said first shoulder strap having a first shoulder strap first end extending to a first shoulder strap second end, said first shoulder strap first end connecting with said lumbar strap adjacent said lumbar strap first end, said first shoulder strap second end connecting with said lumbar strap adjacent said lumbar strap center portion; and said second shoulder strap for strapping over a second shoulder of a wearer of said harness, said second shoulder strap having a second shoulder strap first end extending to a second shoulder strap second end, said second shoulder strap first end connecting with said lumbar strap adjacent said lumbar strap second end, said second shoulder strap second end connecting with said lumbar strap adjacent said lumbar strap center portion.

3. The harness of claim 2, further comprising: said plate having a first side opposite a second side defining a thickness there-between, wherein said chest strap connector, said first shoulder strap connector and said second shoulder strap connectors comprise at least one slot defined through said plate thickness.

4. The harness of claim 3, further comprising: wherein said chest strap connector comprising a first chest strap slot defined through said plate thickness and a second chest strap slot defined through said plate thickness, and said first chest strap slot and said second chest strap slot generally parallel to one another.

5. The harness of claim 3, further comprising: said first shoulder strap connector comprising a first upper shoulder strap slot defined through said plate thickness and a first lower shoulder strap slot defined through said plate thickness, and said first upper strap slot and said first lower shoulder strap slot generally parallel to one another.

6. The harness of claim 3, further comprising: said second shoulder strap connector comprising a second upper shoulder strap slot defined through said plate thickness and a second lower shoulder strap slot defined through said plate thickness, and said second upper strap slot and said second lower shoulder strap slot generally parallel to one another.

7. The harness of claim 2, further comprising: said plate comprising a center point, wherein said chest strap slots and said shoulder strap slots each have centers, wherein said centers are generally equidistant from said center point, and wherein said centers are spaced generally sixty degrees apart from one another.

8. The harness of claim 2, further comprising: said plate having a first side opposite a second side defining a thickness there-between, wherein said handle connector comprises at least one handle strap slot defined through said plate thickness.

9. The harness of claim 8, further comprising said handle connector comprising a first handle strap slot defined through said plate thickness and a second handle strap slot defined through said plate thickness, said first handle strap slot and said second handle strap slot generally parallel to one another.

10. The harness of claim 2, further comprising said handle comprising a handle strap, said handle strap comprising a hand-hold for grasping by said a non-wearer of said harness, said handle strap extending through said hand-hold.

11. The harness of claim 2, wherein said lumbar strap comprises a first lumbar strap segment, a second lumbar strap segment, and a third lumbar strap segment, said first lumbar strap segment extending between said lumbar strap first buckle and a first lumbar strap loop, said second lumbar strap segment extending between a first lumbar strap slide buckle and a second lumbar strap slide buckle, and said third lumbar strap segment extending between said second lumbar strap buckle and a second lumbar strap loop, wherein said third lumbar strap segment extends through said first lumbar strap loop to the first slide buckle and said second lumbar strap loop to the second slide buckle.

12. The harness of claim 2, further comprising:

said first shoulder strap first end and said first shoulder strap second end are fixed to said lumbar strap; wherein said first shoulder strap comprises two segments, namely a first shoulder strap first segment, and a first shoulder strap second segment, said first shoulder strap first segment extending between said lumbar strap first end and a first loop, said first shoulder strap second segment extending between said lumbar strap center portion and a first shoulder strap slide buckle, wherein said first shoulder strap second segment extends through said first loop to the slide buckle; and said second shoulder strap first end and said second shoulder strap second end are fixed to said lumbar strap; wherein said second shoulder strap comprises two segments, namely a second shoulder strap first segment, and a second shoulder strap second segment, said second shoulder strap first segment extending between said lumbar strap first end and a second loop, said second shoulder strap second segment extending between said lumbar strap center portion and a second shoulder strap slide buckle, wherein said second shoulder strap second segment extends through said second shoulder strap loop to the slide buckle.

13. The harness of claim 2, further comprising: said first shoulder strap defining a slot through which said chest strap passes when said chest strap laterally connects to said first shoulder strap, and said second shoulder strap defining a slot through which said chest strap passes when said chest strap laterally connects to said second shoulder strap.

14. The harness of claim 2, further comprising: a first leg strap for strapping around a first leg of a wearer of said harness and a second leg strap for strapping around a second leg of a wearer of said harness.

15. The harness of claim 14, further comprising: wherein said first leg strap and said second leg strap attach to said lumbar strap.

16. The harness of claim 14, further comprising:

wherein said first leg strap has a first leg strap first end extending to a first leg strap second end, said first leg strap first end comprising a first leg strap first buckle, said first leg strap first buckle and said first leg strap second end configured for connection with one another; and wherein said second leg strap has a second leg strap first end extending to a second leg strap second end, said second leg strap first end comprising a second leg strap first buckle, said second leg strap first buckle and said second leg strap second end configured for connection with one another.

17. The harness of claim 2, wherein said lumbar strap first end further comprises a lumbar strap first buckle, said lumbar strap second end further comprises a lumbar strap second buckle, and said lumbar strap first buckle and said lumbar strap second buckle are configured for connection with one another.

18. The harness of claim 17, wherein said chest strap first end further comprises a chest strap first buckle, said chest strap second end comprising a chest strap second buckle, said chest strap first buckle and said chest strap second buckle configured for connection with one another.

19. The harness of claim 18, wherein said lumbar strap first buckle, said lumbar strap second buckle, said chest strap first buckle, and said chest strap second buckle are adjustable buckles.

20. A harness, said harness comprising:

a plate, a handle, a lumbar strap, a chest strap, a first shoulder strap, and a second shoulder strap, said plate defining at least one chest strap connector for connecting with said chest strap, said plate defining at least one first shoulder strap connector for connecting with said first shoulder strap, said plate defining at least one second shoulder strap connector for connecting with said second shoulder strap, said plate defining at least one handle connector for connecting with said handle;

said handle for grasping by a non-wearer of said harness, said handle configured for connection with said plate at said handle connector;

said lumbar strap for strapping around the lower back of a wearer of said harness, said lumbar strap having a lumbar strap first end extending to a lumbar strap second end, said lumbar strap having a center portion generally between said lumbar strap first end and said lumbar strap second end, said lumbar strap first end comprising a lumbar strap first buckle, said lumbar strap second end comprising a lumbar strap second buckle, said lumbar strap first buckle and said lumbar strap second buckle configured for connection with one another, wherein said lumbar strap first buckle and said lumbar strap second buckle are adjustable buckles;

said chest strap for strapping around the chest of a wearer of said harness, said chest strap having a chest strap first end extending to a chest strap second end, said chest strap first end comprising a chest strap first buckle, said chest strap second end comprising a chest strap second buckle, said chest strap first buckle and said chest strap second buckle configured for connection with one another, wherein said chest strap first buckle and said chest strap second buckle are adjustable buckles;

said first shoulder strap for strapping over a first shoulder of a wearer of said harness, said first shoulder strap having a first shoulder strap first end extending to a first shoulder strap second end, said first shoulder strap first end connecting with said lumbar strap adjacent said lumbar strap first end, said first shoulder strap second end connecting with said lumbar strap adjacent said lumbar strap center portion;

said second shoulder strap for strapping over a second shoulder of a wearer of said harness, said second shoulder strap having a second shoulder strap first end extending to a second shoulder strap second end, said second shoulder strap first end connecting with said lumbar strap adjacent said lumbar strap second end, said second shoulder strap second end connecting with said lumbar strap adjacent said lumbar strap center portion; and a first leg strap for strapping around a first leg of a wearer of said harness and a second leg strap for strapping around a second leg of a wearer of said harness, wherein said first leg strap and said second leg strap attach to said lumbar strap, wherein said first leg strap has a first leg strap first end extending to a first leg strap second end, said first leg strap first end comprising a first leg strap first buckle, said first leg strap first buckle and said first leg strap second end configured for connection with one another; and wherein said second leg strap has a second leg strap first end extending to a second leg strap second end, said second leg strap first end comprising a second leg strap first buckle, said second leg strap first buckle and said second leg strap second end configured for connection with one another.

* * * * *